US010390570B2

(12) United States Patent
Petersen

(10) Patent No.: US 10,390,570 B2
(45) Date of Patent: Aug. 27, 2019

(54) PORTABLE SELF-FEEDING BIB

(71) Applicant: Christie Petersen, Carmel, IN (US)

(72) Inventor: Christie Petersen, Carmel, IN (US)

( * ) Notice: Subject to any disclaimer, the term of this patent is extended or adjusted under 35 U.S.C. 154(b) by 0 days.

(21) Appl. No.: 15/133,257

(22) Filed: Apr. 20, 2016

(65) Prior Publication Data

US 2017/0303602 A1 Oct. 26, 2017

(51) Int. Cl.
*A41B 13/10* (2006.01)
*A47G 19/08* (2006.01)

(52) U.S. Cl.
CPC ..... *A41B 13/103* (2013.01); *A47G 19/08* (2013.01)

(58) Field of Classification Search
CPC ..... A41B 13/103; A41B 13/106; B65D 81/3453; A47G 19/08; A47G 21/04
USPC ..... 2/49.2
See application file for complete search history.

(56) References Cited

U.S. PATENT DOCUMENTS 1,591,721 A * 7/1926 Melvin ..... A41B 13/103 2/49.2
3,146,464 A * 9/1964 Burnett ..... A41B 13/103 2/49.3
3,328,807 A * 7/1967 Strauss ..... A41B 13/103 2/49.3
3,540,060 A * 11/1970 Brown ..... A41B 13/103 2/49.2
4,219,283 A * 8/1980 Buckley ..... A46B 7/023 30/324
4,564,957 A * 1/1986 Scharf ..... A41B 13/00 2/49.2
4,601,065 A * 7/1986 Sigl ..... A41B 13/103 2/49.2
4,660,226 A * 4/1987 Quilling ..... A41B 13/103 2/49.2
4,793,004 A * 12/1988 Long ..... A41B 13/103 2/49.3
4,860,381 A 8/1989 Bartley
4,924,527 A * 5/1990 Hintermeyer ..... A41B 13/103 2/46
4,946,094 A * 8/1990 Stang ..... A41B 13/103 2/48
5,062,558 A * 11/1991 Stang ..... A41B 13/103 2/49.2
5,090,572 A * 2/1992 DeRoseau ..... A45C 11/20 206/541
5,218,721 A * 6/1993 Mathews ..... A41B 13/103 2/244
5,312,282 A * 5/1994 Cooper ..... A41B 13/10 2/49.2
5,504,941 A * 4/1996 Sell ..... A41B 13/103 2/247

(Continued)

*Primary Examiner* — Shaun R Hurley
*Assistant Examiner* — Bao-Thieu L Nguyen
(74) *Attorney, Agent, or Firm* — Woodard, Emhardt, Henry, Reeves & Wagner, LLP

(57) ABSTRACT

A portable bib includes a bib and a bowl that can be attached to and easily removed from the bib. The bib includes semi-circular upper sections and fasteners for folding the bib. By fastening the upper sections together, the bib bends slightly to conform to the neck, shoulders, and chest of the individual. The bib can also be fastened to create a folded pocket where the bowl is placed and attached to the bib. The back of the bowl is a concave surface that conforms to the abdomen of the individual. The bib may be easily unfolded for cleaning and storing.

19 Claims, 11 Drawing Sheets

(56) References Cited

U.S. PATENT DOCUMENTS 5,530,968 A * 7/1996 Crockett ..... A41B 13/103 2/243.1
5,705,212 A * 1/1998 Atkinson ..... B65D 51/247 206/542
5,875,490 A * 3/1999 Woodard ..... A41B 13/10 2/48
5,940,974 A * 8/1999 Lee ..... A47G 21/02 30/322
6,058,506 A * 5/2000 Reinhart, Jr. ..... A41B 13/103 2/49.2
6,105,165 A 8/2000 Johnson et al.
6,209,133 B1 * 4/2001 Hinshaw ..... A61J 17/02 2/49.1
7,040,500 B2 * 5/2006 Kipperman ..... A61J 9/00 206/553
7,175,041 B2 * 2/2007 Ekkert ..... B65D 51/246 206/541
7,269,857 B2 * 9/2007 Cymbol ..... A41B 13/103 2/49.1
7,374,046 B1 * 5/2008 O'Brien ..... A45C 11/20 206/216
7,496,970 B2 * 3/2009 Gors ..... A41B 13/103 2/49.2
7,722,049 B2 * 5/2010 Williams ..... A47G 19/025 273/317
8,056,145 B2 * 11/2011 Shamsnobari ..... A47G 21/001 2/46
D682,609 S * 5/2013 Lindsay ..... D7/392.1
8,579,145 B2 * 11/2013 Gold ..... A47G 19/02 206/541
8,757,421 B2 * 6/2014 Yang ..... B65D 51/246 206/223
9,131,763 B2 * 9/2015 Groberg ..... A45F 3/46
9,434,590 B2 * 9/2016 Miksovsky ..... B67B 7/44
2006/0272588 A1 * 12/2006 Decroix ..... A01K 5/0114 119/61.5
2012/0174279 A1 7/2012 Bailey et al.
2013/0019369 A1 1/2013 Bailey et al.
2013/0086725 A1 * 4/2013 Sabre ..... A41B 13/10 2/49.2
2013/0167283 A1 * 7/2013 Graffeo ..... A41B 13/103 2/49.2
2013/0291276 A1 * 11/2013 Monahon ..... A41B 13/103 2/49.2
2014/0374424 A1 * 12/2014 Hickox ..... A47G 23/06 220/575

* cited by examiner

PORTABLE SELF-FEEDING BIB

BACKGROUND

Bibs are generally designed to protect clothing from soiling and are a way of life for many families with young children, and for some adults. Bibs are available in a variety of designs and materials that differ in effectiveness, ease of cleaning, comfort, and other factors. Often a caregiver needs to multitask and, consequently, a bib that does more than just protect clothing but also facilitates feeding an individual would be beneficial.

For parents of young children or toddlers and for some adult caregivers, significant time is spent assisting a child or adult who is generally incapable of feeding themselves. When traveling via car or stroller, or otherwise moving about, it may be difficult for the caregiver to assist with feeding. For example, a parent that is driving would not be able to get food or snacks for a child in a car seat. Furthermore, a child or adult given an unattached bowl of food is more likely to set the bowl down or spill the contents.

Therefore, there is a need for a bib that can protect an individual's clothing while at the same time facilitate feeding that individual who needs minor assistance. The bib would include a bowl attached to the bib that would allow individuals to eat at their leisure and prevent soiling of the individual's clothing. Furthermore, the bib would be portable such that an individual could eat easily while the individual is moving or being transported.

SUMMARY OF THE DISCLOSED EMBODIMENTS

In one aspect, a portable bib is provided. The portable bib includes a bib and a bowl that can be attached to and easily removed from the bib. The bib includes semi-circular upper sections that can be attached together around the neck of an individual. By fastening the upper sections together, the bib bends slightly to conform to the neck, shoulders, and chest of the individual. The portable bib also includes a folded pocket where the bowl is placed and attached to the bib. The folded pocket spans substantially the entire length of the front surface of the bib and extends from the bottom of the bib upward to a location at or below the middle of the front surface of the bib. The bib may be easily unfolded for cleaning and storing. In one embodiment, the bib is constructed of flexible, waterproof material. In another embodiment, the bib is machine washable and dryer safe.

The bib also includes one or more fasteners in which certain complementary fasteners can be connected to form the portable bib. By way of nonlimiting example, the one or more fasteners can be snaps, buttons, hook and loop fasteners, magnets, buckles, and/or clasps. At least one fastener is located at the end of each semi-circular upper section such that the upper sections can be attached together around the neck of an individual. Other complementary fasteners can be connected to form the folded pocket for the bowl. In another embodiment, at least one fastener on the bib corresponds to at least one fastener located on the bowl such that the bowl may be securely attached inside the folded pocket of the bib. The operation of the fasteners allows for stability and security for the portable bib while permitting easy removal and replacement of the bowl and disassembly of the bib for cleaning of the bowl and the bib.

The bowl of the portable bib includes two sides, a front, a back, and a bottom. In one embodiment, the back of the bowl is a concave surface such that the bowl and the bib conform to the abdomen of the individual. The front of the bowl may have any surface configuration that permits the bowl to fit securely inside the folded pocket of the bib. In one embodiment, the sides, front, and back of the bowl are tapered toward the bottom of the bowl to provide a better fit inside the folded pocket of the bib. In another embodiment, the bowl is constructed of a dishwasher safe plastic polymer. In a further embodiment, the bowl is microwavable.

In one embodiment, the interior of the bowl may be sealed by a lid that fits over the top of the bowl. The lid includes two sides, a front, a back, and a top such that the sides, front, and back of the lid correspond to and fasten securely to the sides, front, and back of the bowl. In one embodiment, the back of the lid is a concave surface that complements the concave surface of the back of the bowl. In another embodiment, the lid includes a lip that complements a lip on the bowl such that the connection between the lip of the lid and the lip of the bowl provides a leak-proof seal. In a further embodiment, the lid is constructed of a dishwasher safe plastic polymer.

In another embodiment, the bowl includes a spoon. The length of the spoon allows the spoon to fit inside the bowl with the lid in place but also prevents the spoon from falling to the bottom of the bowl. In one embodiment, the spoon is constructed of a dishwasher safe plastic polymer.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
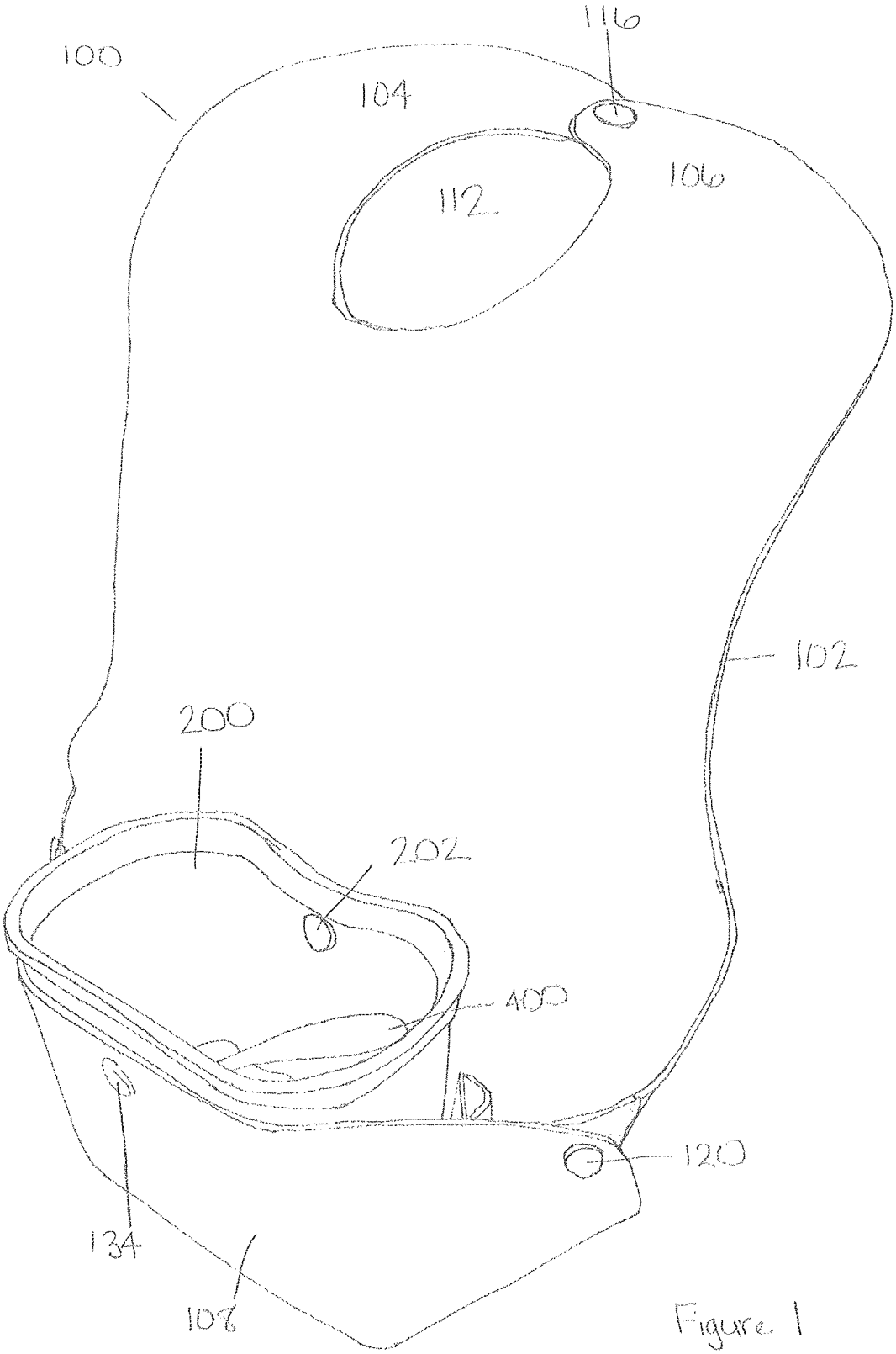
FIG. 1 illustrates a front-side perspective view of a portable bib and attached bowl according to an embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 illustrates an embodiment of a portable bib 100 comprising a bib 102 and an attached bowl 200. The bib 102 comprises upper section 104 and upper section 106, which are semi-circular sections that fasten together to create opening 112. The upper sections 104 and 106 and opening 112 allow the bib 102 to be attached around an individual's neck. The bib 102 of portable bib 100 is shown in FIG. 1 in a folded configuration such that the bib 102 also comprises a folded pocket 108 for holding the bowl 200 such that folded pocket 108 spans substantially the entire length of the front surface of the bib 102. The folded pocket 108 extends from the bottom of the bib 102 upward to a location at or below the middle of the front surface of the bib 102.

Figure 2:
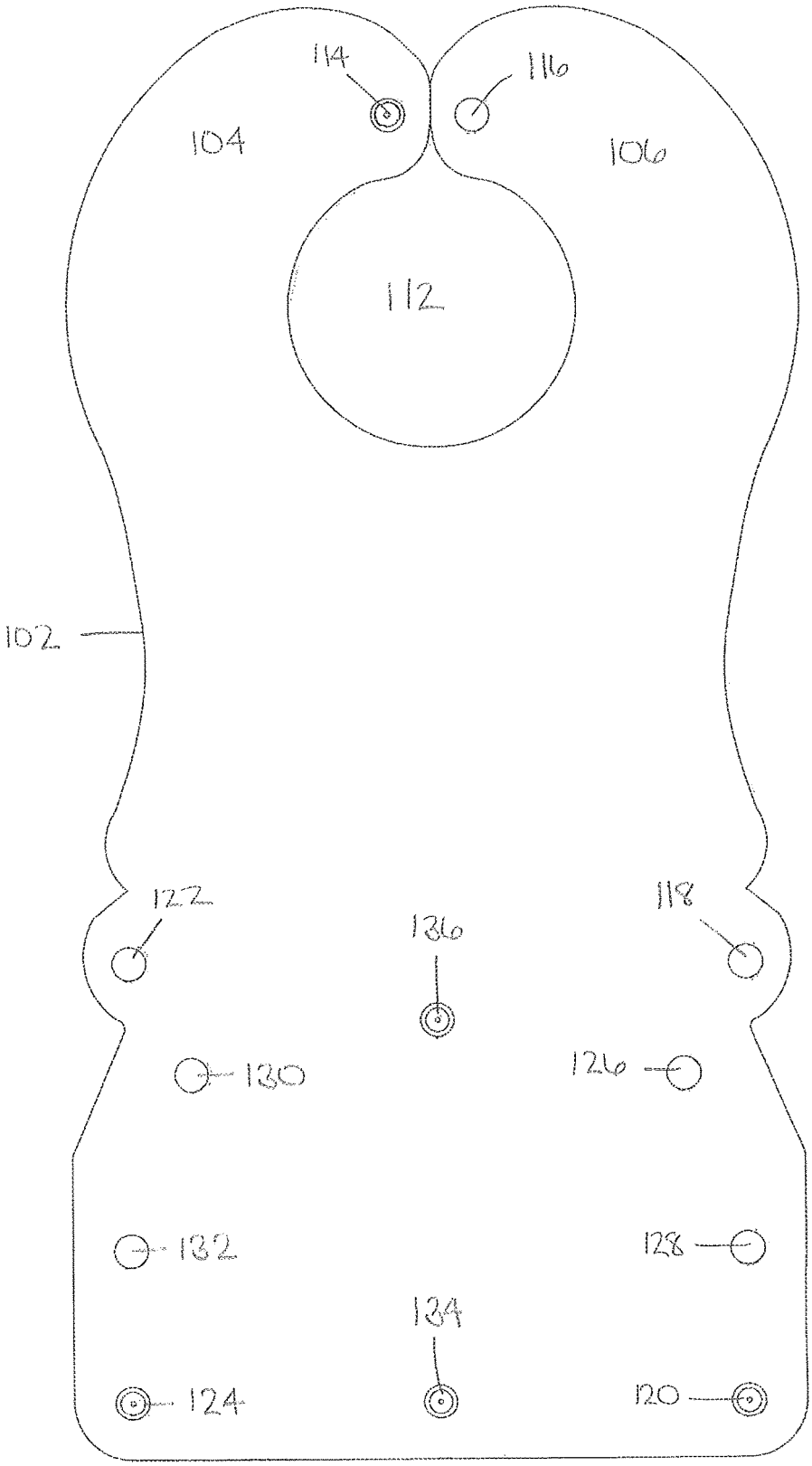
FIG. 2 illustrates a front view of an unfolded bib according to an embodiment of the present disclosure.

FIG. 2 illustrates an embodiment of bib 102 in an unfolded configuration. The upper section 104 includes fastener 114, and the upper section 106 includes fastener 116. The fasteners 114 and 116 are complementary such that the upper sections 104 and 106 can be connected by attaching the fastener 116 to the fastener 114. When the fastener 116 is connected to the fastener 114, the upper section 106 and the fastener 116 overlay a portion of the upper section 104 and the fastener 114. The upper sections 104 and 106 bend slightly when connected via the fasteners 114 and 116 so that the bib 102 conforms to the neck, shoulders, and chest of the individual.

Figure 3:
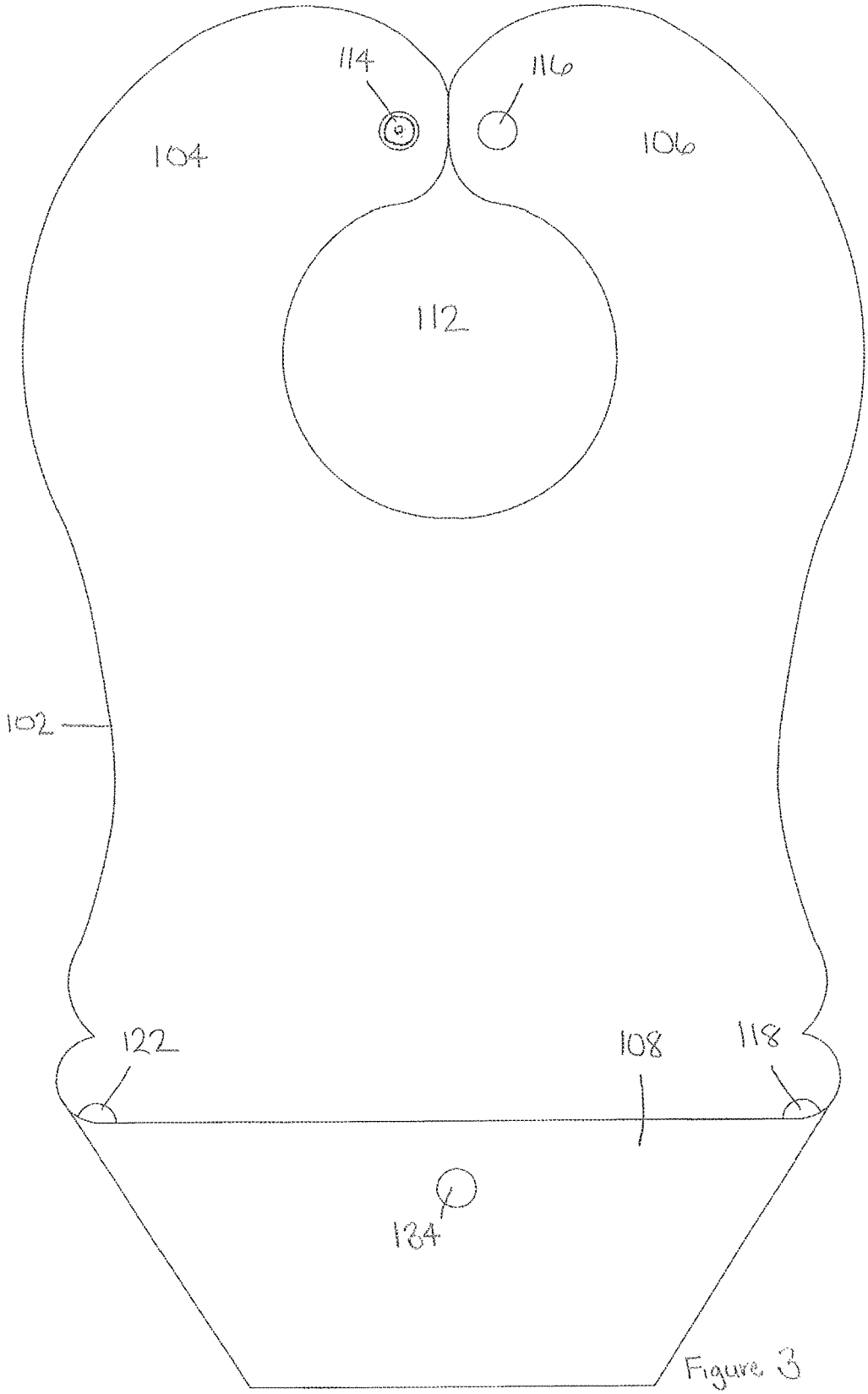
FIG. 3 illustrates a front view of a folded bib according to an embodiment of the present disclosure.
Figures 4A, 4B:
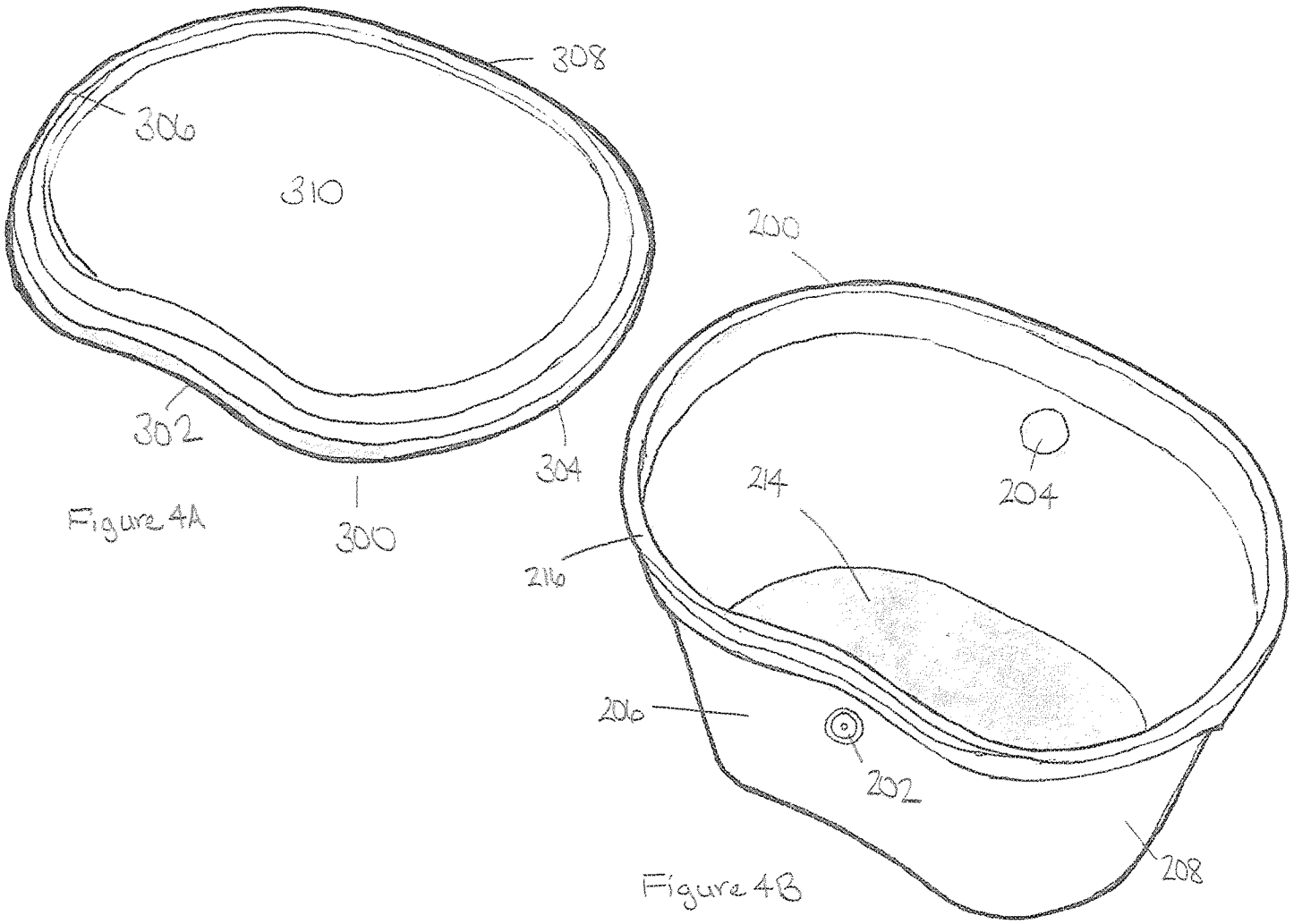
FIG. 4A illustrates a top-side perspective view of a lid according to an embodiment of the present disclosure.
FIG. 4B illustrates a top-side perspective view of a bowl according to an embodiment of the present disclosure.
Figure 5:
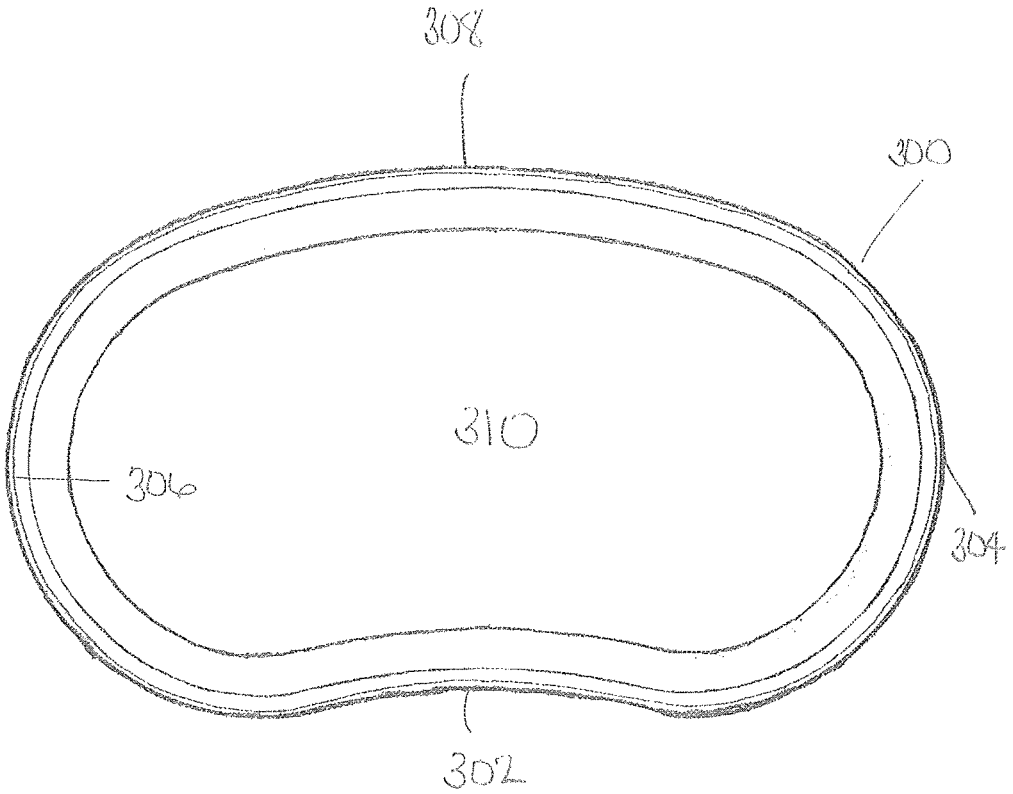
FIG. 5 illustrates a top view of a lid according to an embodiment of the present disclosure.

As shown in FIGS. 1-3, the folded pocket 108 is formed by connecting certain fasteners of bib 102. The bottom of the bib 102 is folded such that the fasteners 120 and 124 are brought up and to the back of the bib 102 to connect with the complementary fasteners 118 and 122, respectively, on the back of the bib 102. The sides of the folded pocket 108 are formed by the edges of the bib 102 between the fasteners 118 and 120 and between the fasteners 122 and 124 folding inward toward the center of the folded pocket 108 such that the fasteners 128 and 132 are attached to the corresponding fasteners 126 and 130, respectively. The fasteners 134 and 136 are used to attach the bowl 200 to the folded pocket 108 of the bib 102.

FIGS. 4-11 illustrate an embodiment of the bowl 200 and a lid 300. As seen in FIGS. 4B and 7-11, the bowl 200 includes sides 208 and 210, a front 212, a back 206, and a bottom 214. The sides 208 and 210, the front 212, and the back 206 can be tapered toward the bottom 214 to enable the bowl 200 to fit properly inside the folded pocket 208 of the bib 102. The back 206 of the bowl 200 is a concave surface so that the bowl 200 and the bib 102 conform to the abdomen of the individual. The fasteners 202 and 204 of the bowl 200 attach the bowl 200 to the folded pocket 208 of the bib 102 by connecting to the complementary fasteners 136 and 134 of the bib 102.

Figure 6:
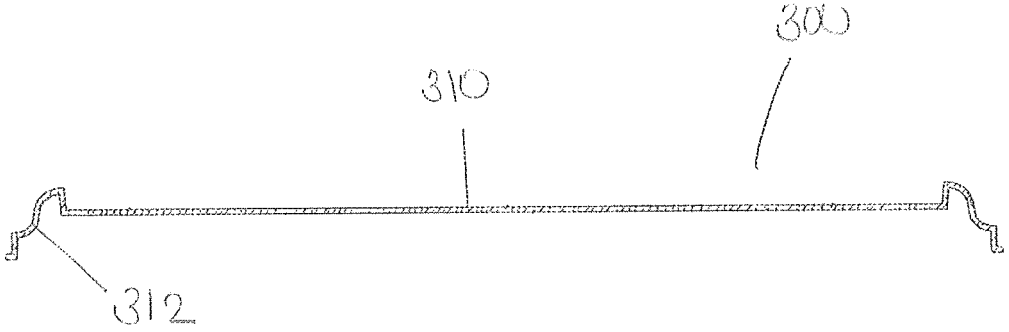
FIG. 6 illustrates a cross-sectional view of a lid according to an embodiment of the present disclosure.
Figure 7:
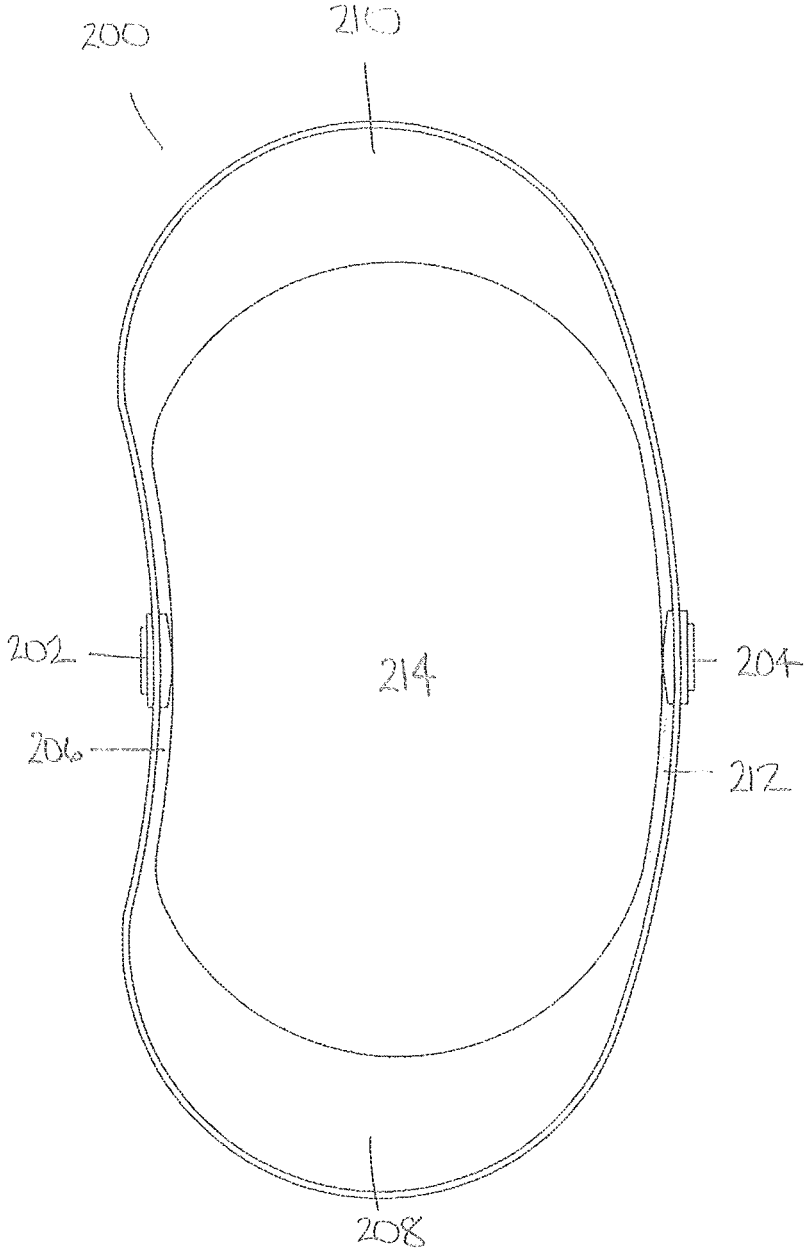
FIG. 7 illustrates a top view of a bowl according to an embodiment of the present disclosure.
Figure 8:
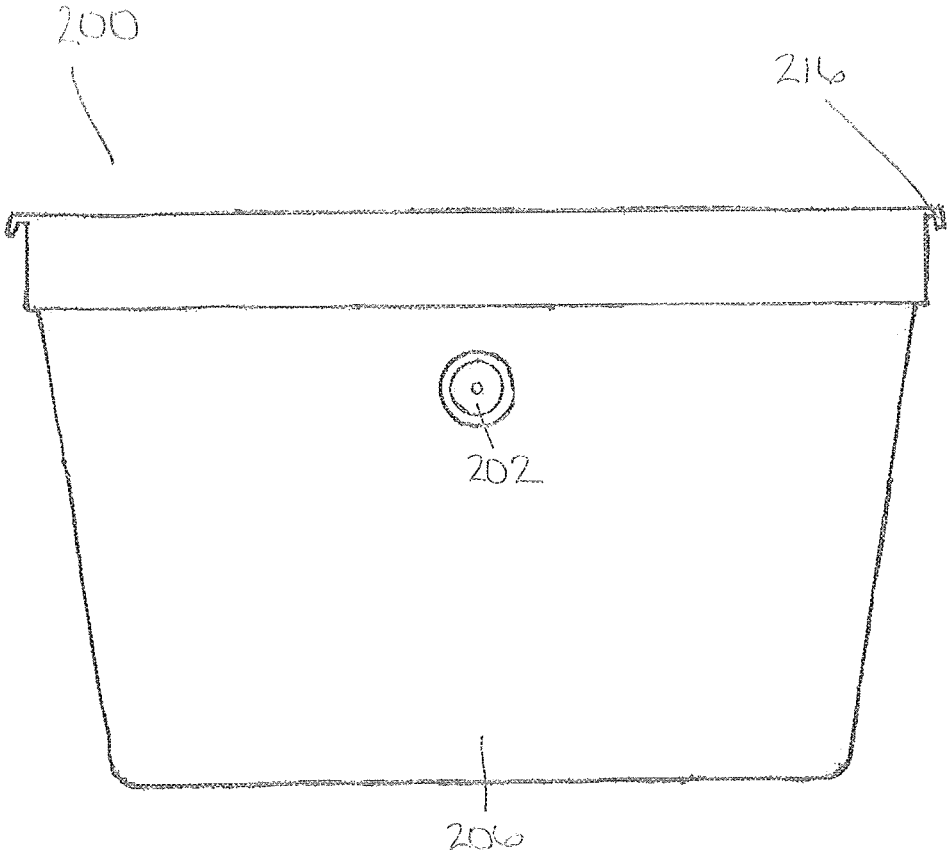
FIG. 8 illustrates a back view of a bowl according to an embodiment of the present disclosure.
Figure 9:
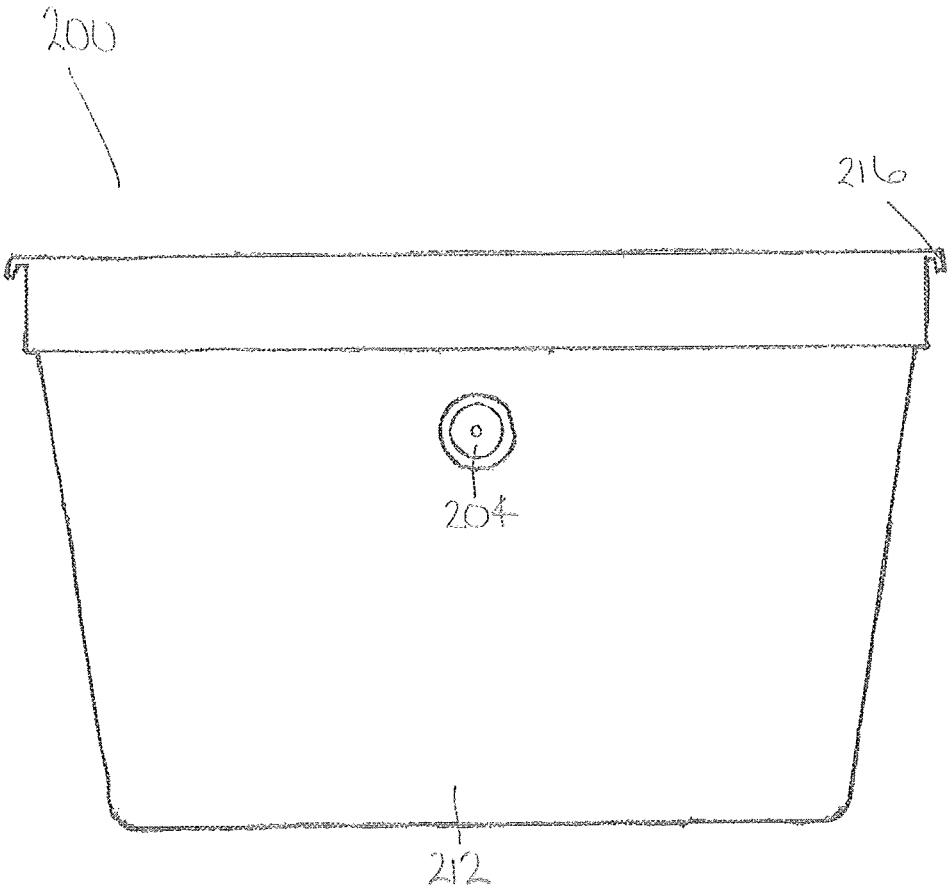
FIG. 9 illustrates a front view of a bowl according to an embodiment of the present disclosure.
Figure 10:
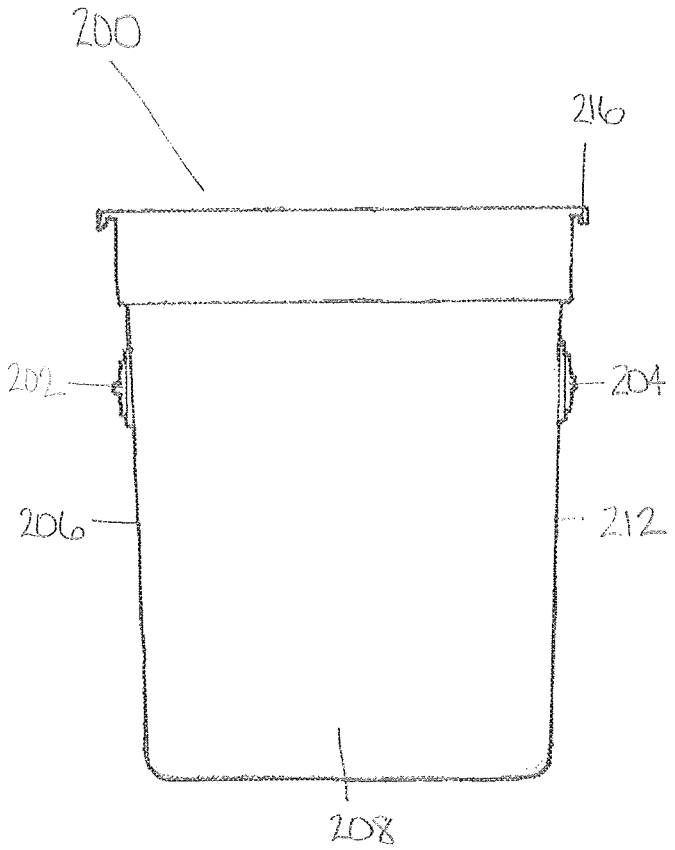
FIG. 10 illustrates a side view of a bowl according to an embodiment of the present disclosure.
Figure 11:
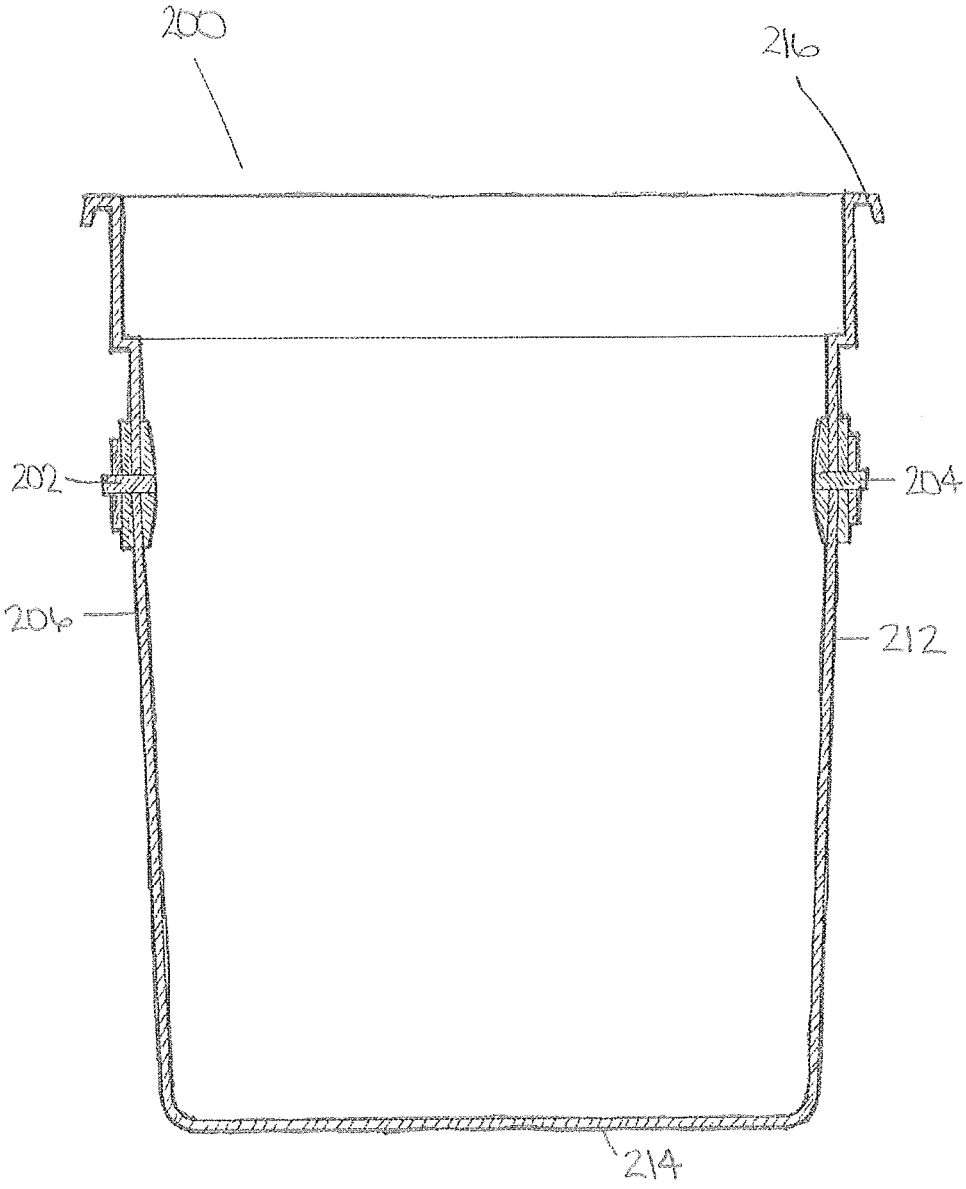
FIG. 11 illustrates a cross-sectional view of a bowl according to an embodiment of the present disclosure.

As illustrated in FIGS. 8-11, the bowl 200 comprises a lip 216 along the top of the bowl 200 for ensuring a tight fit with the lid 300 and the complementary lip 312 of the lid 300, as shown in FIG. 6. The lid 300 also comprises sides 304 and 306, a front 308, a back 302, and a top 310. The sides 304 and 306, the front 308, and the back 302 of the lid 300 align with the sides 208 and 210, the front 212, and the back 206 of the bowl 200 such that the lid 300 can be attached to the bowl 200. The back 302 of the lid 300 is a concave surface to correspond to the shape of the back 206 of the bowl 200. These features allow the lid 300 to be tightly sealed to the bowl 200 to prevent leaks.

As shown in FIG. 1, the bowl 200 may include a spoon 400. The length of the spoon 400 allows the spoon 400 to fit inside the bowl 200 with the lid 300 in place but also prevents the spoon 400 from falling to the bottom of the bowl 200.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. A portable bib and bowl system comprising:

a bib formed from a planar sheet of flexible material, the planar sheet having a front and back surface, right and left edges, a bottom edge and two upper sections opposite the bottom edge for removably attaching the bib around an individual's neck;

a first pocket fastener adjacent the right edge of the planar sheet positioned at or below a middle of the planar sheet;

a second pocket fastener adjacent the right edge of the planar sheet and adjacent the bottom edge of the planar sheet;

a third pocket fastener adjacent the left edge of the planar sheet and horizontally aligned with the first pocket fastener;

a fourth pocket fastener adjacent the left edge of the planar sheet horizontally aligned with the second pocket fastener, wherein the planar sheet is folded to form a folded pocket spanning a width of the front surface of the bib with the first and second pocket fasteners connected together with the front surface facing the back surface and the third and fourth pocket fasteners connected together with the front surface facing the back surface, wherein the right edge of the planar sheet positioned between the first and second pocket fasteners is folded inward toward the center of the folded pocket, wherein the folded pocket extends from the bottom of the bib upward to a location at or below the middle of the front surface of the bib;

a bowl having at least one bowl fastener and shaped to fit inside the folded pocket of the bib, and wherein the bowl comprises two sides, a front, a back and a bottom; and at least one complementary bowl fastener located on the front surface of the bib that complements the at least one bowl fastener on the bowl to removably attach the bowl inside the folded pocket of the bib.

2. The portable bib and bowl system of claim 1, wherein the planar sheet is a flexible, waterproof material.

3. The portable bib and bowl system of claim 1, wherein the pocket fasteners are selected from the group consisting of snaps, buttons, hook and loop fasteners, magnets, buckles, and clasps.

4. The portable bib and bowl system of claim 1, wherein the pocket fasteners are snaps.

5. The portable bib and bowl system of claim 1, wherein the bowl is sealed by a lid that fits over the top of the bowl.

6. The portable bib and bowl system of claim 1, wherein the back of the bowl comprises a concave surface that is configured to curve inward in the direction of the front of the bowl.

7. The portable bib and bowl system of claim 1, wherein the right edge between the first and second pocket fasteners and left edges edge between the third and fourth fasteners of the planar sheet are curved.

8. The portable bib and bowl system of claim 7, wherein the left edge of the planar sheet positioned between the third and fourth pocket fasteners is folded inward toward the center of the folded pocket.

9. The portable bib and bowl system of claim 8, further comprising:

a fifth pocket fastener adjacent the right edge of the planar sheet positioned below the first pocket fastener;

a sixth pocket fastener adjacent the right edge of the planar sheet positioned between the fifth and second pocket fasteners;

a seventh pocket fastener adjacent the left edge of the planar sheet and horizontally aligned with the fifth pocket fastener;

an eighth pocket fastener adjacent the left edge of the planar sheet and horizontally aligned with the sixth pocket fastener, wherein the fifth and sixth pocket fasteners are connected together and the seventh and eighth pocket fasteners are connected together.

10. The portable bib and bowl system of claim 9, wherein the pocket fasteners are selected from the group consisting of snaps, buttons, hook and loop fasteners, magnets, buckles, and clasps.

11. The portable bib and bowl system of claim 9, wherein the pocket fasteners are snaps.

12. The portable bib and bowl system of claim 1, wherein the bowl further comprises a first bowl fastener on the front of the bowl and a second bowl fastener on the back of the bowl and wherein the planar sheet of flexible material further comprises a third bowl fastener on the front surface adjacent the bottom edge and a fourth bowl fastener on the front surface at or below the middle of the front surface of the planar sheet, and wherein the first and third bowl fasteners are connected together and the second and fourth bowl fasteners are connected together.

13. The portable bib and bowl system of claim 1, wherein the front surface of the planar sheet abuts the back surface of the planar sheet where the first and second pocket fasteners connect together.

14. A portable bib and bowl system comprising:

a bib formed from a planar sheet of flexible material, the planar sheet having a front and back surface, right and left edges, a bottom edge and two upper sections opposite the bottom edge for removably attaching the bib around an individual's neck;

a first pocket fastener adjacent the right edge of the planar sheet positioned at or below a middle of the planar sheet;

a second pocket fastener adjacent the right edge of the planar sheet and adjacent the bottom edge of the planar sheet;

a third pocket fastener adjacent the left edge of the planar sheet and horizontally aligned with the first pocket fastener;

a fourth pocket fastener adjacent the left edge of the planar sheet horizontally aligned with the second pocket fastener;

a fifth pocket fastener adjacent the right edge of the planar sheet positioned below the first pocket fastener;

a sixth pocket fastener adjacent the right edge of the planar sheet positioned between the fifth and second pocket fasteners;

a seventh pocket fastener adjacent the left edge of the planar sheet and horizontally aligned with the fifth pocket fastener;

an eighth pocket fastener adjacent the left edge of the planar sheet and horizontally aligned with the sixth pocket fastener, wherein the fifth and sixth pocket fasteners are connected together and the seventh and eighth pocket fasteners are connected together, wherein the planar sheet is folded to form a folded pocket spanning a width of the front surface of the bib with the first and second pocket fasteners connected together and the third and fourth pocket fasteners connected together, wherein the right edge of the planar sheet positioned between the first and second pocket fasteners is folded inward toward the center of the folded pocket, wherein the folded pocket extends from the bottom of the bib upward to a location at or below the middle of the front surface of the bib;

a bowl having at least one bowl fastener and shaped to fit inside the folded pocket of the bib, and wherein the bowl comprises two sides, a front, a back and a bottom; and at least one complementary bowl fastener located on the front surface of the bib that complements the at least one bowl fastener on the bowl to removably attach the bowl inside the folded pocket of the bib.

15. The portable bib and bowl system of claim 14, wherein the pocket fasteners are selected from the group consisting of snaps, buttons, hook and loop fasteners, magnets, buckles, and clasps.

16. The portable bib and bowl system of claim 14, wherein the pocket fasteners are snaps.

17. The portable bib and bowl system of claim 14, wherein the fifth and sixth pocket fasteners connect together on the back surface of the planar sheet.

18. The portable bib and bowl system of claim 14, wherein the right edge between the first and second pocket fasteners and left edge between the third and fourth pocket fasteners of the planar sheet are curved.

19. A portable bib and bowl system comprising:

a bib formed from a planar sheet of flexible material, the planar sheet having a front and back surface, right and left edges, a bottom edge and two upper sections opposite the bottom edge for removably attaching the bib around an individual's neck;

a first pocket fastener adjacent the right edge of the planar sheet positioned at or below a middle of the planar sheet;

a second pocket fastener adjacent the right edge of the planar sheet and adjacent the bottom edge of the planar sheet;

a third pocket fastener adjacent the left edge of the planar sheet and horizontally aligned with the first pocket fastener;

a fourth pocket fastener adjacent the left edge of the planar sheet horizontally aligned with the second pocket fastener;

a fifth pocket fastener adjacent the right edge of the planar sheet positioned below the first pocket fastener;

a sixth pocket fastener adjacent the right edge of the planar sheet positioned between the fifth and second pocket fasteners;

a seventh pocket fastener adjacent the left edge of the planar sheet and horizontally aligned with the fifth pocket fastener; and an eighth pocket fastener adjacent the left edge of the planar sheet and horizontally aligned with the sixth pocket fastener, wherein the fifth and sixth pocket fasteners are connected together and the seventh and eighth pocket fasteners are connected together, wherein the planar sheet is folded to form a folded pocket spanning a width of the front surface of the bib with the first and second pocket fasteners connected together and the third and fourth pocket fasteners connected together, wherein the folded pocket extends from the bottom of the bib upward to a location at or below the middle of the front surface of the bib.

* * * * *